United States Patent [19]

Magnan

[11] Patent Number: 4,767,890

[45] Date of Patent: Aug. 30, 1988

[54] HIGH FIDELITY AUDIO CABLE

[76] Inventor: David L. Magnan, 1251 Dara St., Camarillo, Calif. 93010

[21] Appl. No.: 931,251

[22] Filed: Nov. 17, 1986

[51] Int. Cl.[4] ..... H01B 11/00

[52] U.S. Cl. ..... 174/28; 174/29; 174/102 R; 174/113 C; 174/114 R; 174/115

[58] Field of Search ..... 174/28, 29, 113 C, 114 R, 174/102 R, 115

[56] References Cited

U.S. PATENT DOCUMENTS

| | | | |
|---|---|---|---|
| 240,108 | 4/1881 | Eaton | 174/102 R |
| 1,818,027 | 8/1931 | Affel et al. | 174/28 |
| 2,488,211 | 11/1949 | Lemon | 174/28 |
| 2,556,244 | 6/1951 | Weston | 174/29 |
| 2,614,172 | 10/1952 | Greenfield et al. | 174/29 |
| 3,014,087 | 12/1961 | Kaplan | 174/113 C |
| 3,309,455 | 3/1967 | Mildner | 174/29 |
| 3,594,491 | 7/1971 | Zeidlhack | 174/115 X |
| 3,603,715 | 9/1971 | Eilhardt | 174/29 X |
| 4,010,619 | 3/1977 | Hightower et al. | 174/113 C X |
| 4,538,022 | 8/1985 | Barnicol-Ottler et al. | 174/113 C X |
| 4,538,023 | 8/1985 | Brisson | 174/128 R X |

FOREIGN PATENT DOCUMENTS

| | | | |
|---|---|---|---|
| 445359 | 2/1949 | Italy | 174/29 |
| 623730 | 5/1949 | United Kingdom | 174/29 |

*Primary Examiner*—Morris H. Nimmo
*Attorney, Agent, or Firm*—Donald A. Streck

[57] ABSTRACT

A two conductor audio cable having no delay from end to end as a function of the frequency of audio signals conducted therethrough. There are a pair of conductor assemblies each comprising an elongated cylindrical core member of a flexible insulating material extending between the ends of the cable. A plurality of strands of an electrical conducting material are longitudinally disposed between the ends of the cable along the outer surface of the core member to define a cylindrical conductor which is, in essence, all "skin". The strands are electrically insulated from one another. A cylindrical support tube of a flexible insulating material is disposed over the core member and extends between the ends of the cable and is supported concentrically about and spaced from the core member by a helically wrapped support tube. A flexible electrical shield of braided material is disposed around the pair of support tubes and extends between the ends of the cable for holding the support tubes together in parallel relationship and for providing electrical shielding for the conducting strands therein. An external, shielded ground return capable of conducting higher levels of DC is also proved outside of the main braided shield.

18 Claims, 4 Drawing Sheets

HIGH FIDELITY AUDIO CABLE

BACKGROUND OF THE INVENTION

The present invention relates to audio cables used for interconnecting components in high fidelity applications and, more particularly, to a two conductor audio cable having no delay from end to end as a function of the frequency of audio signals conducted therethrough comprising, a first elongated cylindrical core member of a flexible insulating material extending between the ends of the cable; a plurality of first strands of an electrical conducting material longitudinally disposed between the ends of the cable along the outer surface of the first core member, the first strands being electrically insulated from one another; a first cylindrical support tube of a flexible insulating material disposed over the first core member and extending between the ends of the cable; first support means for supporting the first support tube concentrically about and spaced from the first core member; a second elongated cylindrical core member of a flexible insulating material extending between the ends of the cable; a plurality of second strands of an electrical conducting material longitudinally disposed between the ends of the cable along the outer surface of the second core member, the second strands being electrically insulated from one another; a second cylindrical support tube of a flexible insulating material disposed over the second core member and extending between the ends of the cable; second support means for supporting the second support tube concentrically about and spaced from the second core member; and, flexible electrical shield means disposed around the first and second support tubes and extending between the ends of the cable for holding the support tubes together in parallel relationship and for providing electrical shielding for the first and second strands.

As with the proverbial chain which is only as strong as its weakest link, a true high fidelity audio system is only as good as its poorest component. The true "audiophile", therefore, assures that all components which produce and transmit the signals representing the final reproduced audio neither lose, modify, or add to those signals.

An often overlooked aspect of a good audio system is the cable or wire used, for example, to connect between turntable, pre-amplifier, power amplifier and the speakers producing the ultimate audio. In fact, these connecting cables are often the "weak link" in an otherwise outstanding audio system. This is largely as a result of the so-called "skin effect" of a broad-band audio signal. When signals at audio frequencies are transmitted through a cable comprising a plurality of conductors, the high frequency components move towards the conductors on the outside of the cable and travel at a faster speed than the lower frequency components which move towards the conductors at the center of the cable and travel at a slower speed. Since the signals of the various components arrive at and drive the speakers at different times, the result is what can best be described as a smearing or smudging of the reproduced sound.

The above-described problem of conventional audio cables and a proposed solution therefor is addressed in U.S. Pat. No. 4,538,023 of Brisson. The approach of Brisson is shown in FIGS. 1 and 2. FIG. 1 is substantially a reproduction of FIG. 1 of the Brisson patent. Brisson's approach is to construct a multi-conductor cable which works within the constraints of the skin effect; that is, to make a short center conductor having conductors therearound which are increasingly longer in length. The idea is to have the time for travel of the various frequencies from end to end be identical by making them travel a length functionally related to the speed of travel. In the Brisson cable, generally indicated as 10 in FIG. 1, there is an insulated center conductor 12 running straight along the center of the cable. Around the center conductor 12 are a plurality of insulated middle conductors 14. As represented by the relative length lines with corresponding numbers of FIG. 2, the middle conductors 14 are longer than the center conductor 12. To make the cable of constant length, the middle conductors 14 are helically wrapped about the center conductor 12. Around the middle conductors 14 are a plurality of multi-wire outer conductors 16. Again, as represented by the relative length lines of FIG. 2, the outer conductors 16 are longer than the middle conductors 14 and the center conductor 12. To make the cable of constant length, the outer conductors 14 are helically wrapped about the middle conductors 14 and the center conductor 12. The entire bundle is held together by an outer plastic casing 18.

As will be appreciated by those skilled in the art, the Brisson approach is better than a standard, multi-conductor wire; but, assumes that the frequencies will conveniently divide into three groups and will take the right paths to arrive at the other end simultaneously. It also assumes that the differences in length between the conductors 12, 14, and 16 is the required difference to make the timing come out equal. The patent doesn't indicate or teach how to calculate the differences in conductor length; therefore, one must assume that Brisson is advocating only "longer" towards the outside on a best guess basis and expecting nothing more than an improvement over straight wire—and not a solution to the problem.

Wherefore, it is the object of the present invention to provide a cable which automatically eliminates the time shift by frequency associated with skin effect.

It is a further object of the present invention to provide a dual conductor audio cable which does not delay signals passing therethrough as a function of their frequency.

SUMMARY

The foregoing object has been achieved by a cable wherein all the conductors are located at the "skin" such that there is no capability for the cable to cause time shifts by signals travelling at radially different points in the cross-section of the cable.

This has been accomplished by having the cable comprise a number of fine, separately insulated conductors arranged to approximate a thin conducting cylinder.

More particularly, the objects have been achieved in an audio cable comprised of a pair of conducting cables each comprising, an elongated cylindrical core member of a flexible insulating material extending between the ends of the cable; a plurality of strands of an electrical conducting material longitudinally disposed between the ends of the cable along the outer surface of the core member, the strands being electrically insulated from one another; spacer means disposed along the length of the core member for defining a cylindrical support area radially spaced from the outer surface of the core member; and, electrical shield means disposed on the spacer means.

In the preferred audio cable, the spacer means of each conducting cable comprises an elongated spacer member of a flexible insulating material helically wrapped about the core member having a cylindrical support tube of a flexible insulating material disposed over and supported by the spacer member and the electrical shield is a braided shield covering the two support tubes in combination.

In the preferred embodiment, the strands are individually insulated and are helically wrapped around the core member.

DESCRIPTION OF THE PREFERRED EMBODIMENT

Whereas the cable of the Brisson patent as described above attempted to adjust the construction of a relatively conventional cable to work within the constraints imposed by the skin effect, the present invention is a new construction for a cable conducting audio-range signals wherein the skin effect is essentially eliminated. Stated another way, the cable construction of the present invention is essentially all "skin", with no conductor in the center of the cable and, therefore, no capability for relative phase shifts between audio frequencies predominantly propagated through the interior and on or near the surface of the overall conductor. The separately insulated fine conductors employed to conduct the signal are thin enough to individually cause little or no skin effect phase shift in the audio band.

Figure 1:
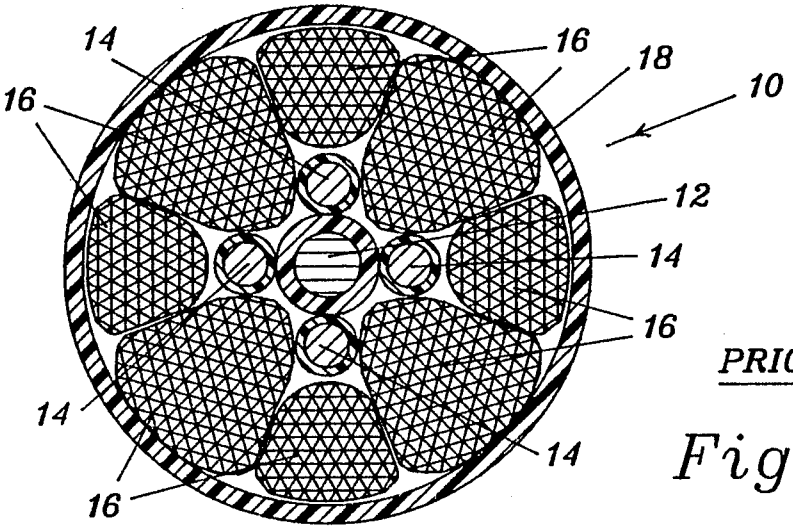
PRIOR ART Fig. 1
FIG. 1 is a simplified cutaway end view of a prior art audio cable.
Figure 2:
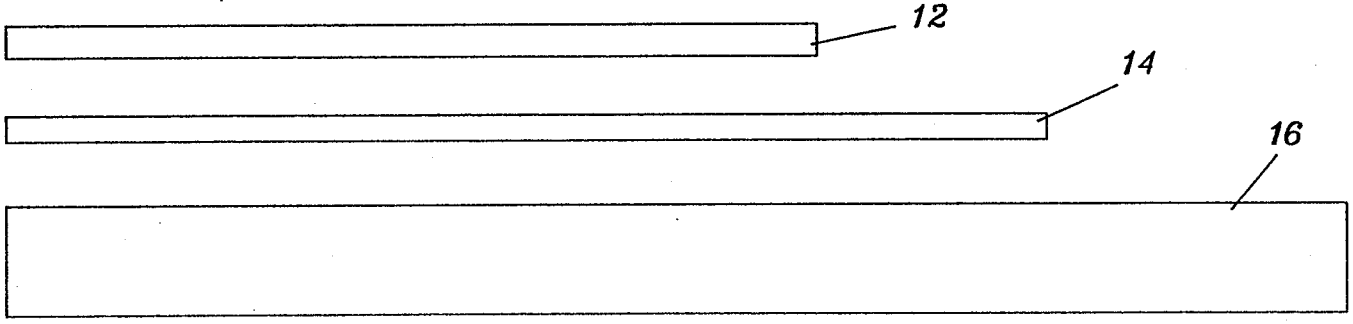
PRIOR ART Fig. 2
FIG. 2 is a simplified representation of the manner in which the cable of FIG. 1 attempts to eliminate differences in time for signals to go from end to end as a function of the frequency thereof.
Figures 3, 4:
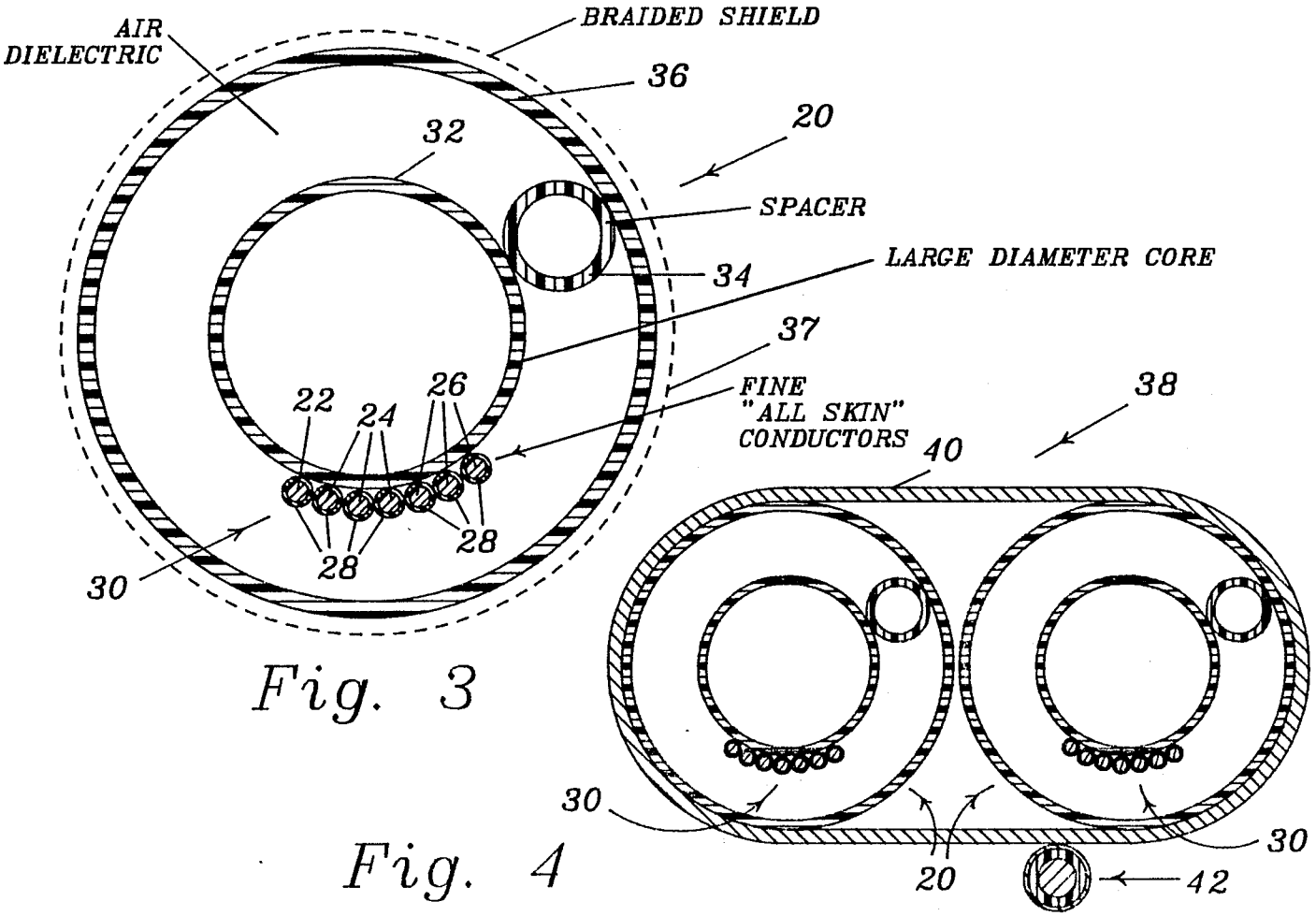
FIG. 3 is a simplified cutaway end view of a single conductor cable according to the present invention.
FIG. 4 is a simplified cutaway end view of a dual conductor audio cable according to the present invention in its preferred embodiment.
Figure 5:
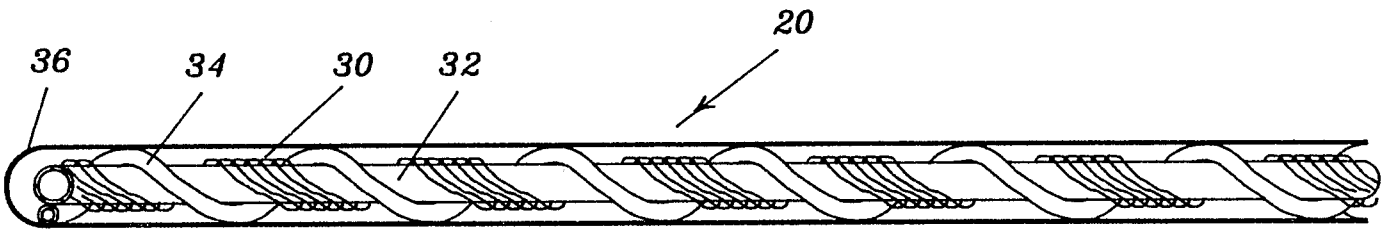
FIG. 5 is a simplified partially cutaway side view of a section of the cable of FIG. 3.
Figure 6:
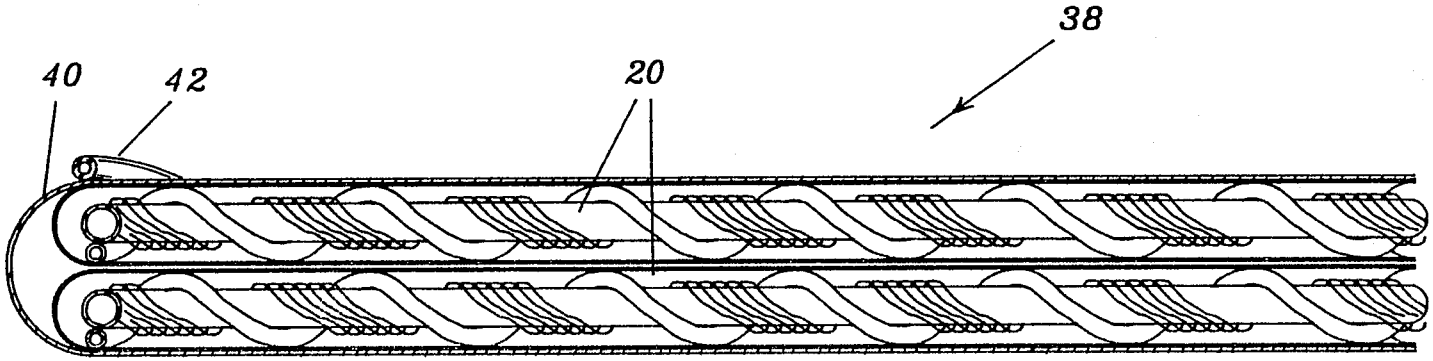
FIG. 6 is a simplified partially cutaway side view of a section of the preferred embodiment for an audio cable of FIG. 4.

A single cable assembly according to the novel construction of the present invention is shown in FIGS. 3 and 5 while the preferred two conductor audio cable employing two such assemblies in combination is shown in FIGS. 4 and 6. While not preferred, two single cable assemblies, each individually shielded, could be used.

The basic conducting cable assembly is generally indicated as 20. In the preferred construction, the actual electrical conductors of the signal consist of one 84-gage, three 37-gage, and three 40-gage OFHC copper conductors 22, 24, 26 in fine, approximately 26-gage TFE Teflon tubes 28, all generally indicated as 30. These insulated conductors 30 are helically spiraled around a 10-gage TFE Teflon tube 32 which acts as a cylindrical core member for the cable. A 17-gage TFE Teflon tube 34 acts as a spacer to position the conducting tube (i.e. the conductors 30 on the periphery of the core tube 32) concentrically inside a large, 1-gage outer TFE Teflon tube 36. This construction provides mostly air dielectric with the rest of the dielectric being TFE Teflon, which though not as good as air, is one of the best plastic dielectrics available in term of dielectric absorption. As those skilled in the art will appreciate, the quality of the dielectric and the use of OFHC copper in the conductors 30 is important to the ultimate audio quality of the cable when used in high fidelity systems.

The tubes 34, 36, of course define a cylindrical support area radially spaced from the outer conducting surface of the core tube 32 which can be used to support a braided shield, such as that indicated by the dotted line 37, for example. In the preferred two conductor audio cable of FIGS. 4 and 6, generally indicated as 38, two of the assemblies 20 as previously described are employed in combination—one for signal and one for return—in a balanced twinaxial construction with an outer braided shield 40 grounded to one end (preferably located at the signal source, to minimize "common mode" noise). Because of the relatively high DC resistance of the balanced return conductor, a separate external ground return 42 is provided. The ground return 42 is an insulated 24-gage OFHC copper conductor, the same length as the internal conductors 30, inside a small braided shield, wrapped helically around the outside of the main braided shield 40 containing the signal and return conductors 30. The external ground return 42 shield is grounded at the same end as the main shield 40.

Returning to the conductors 30, for a moment, the preferred construction is as shown with individual strand conductors 22, 24, 26 within their insulating tubes 28 helically spiraled around the core tube 32. Separate insulation of each conductor is required primarily to eliminate strand-to-strand partial conduction or diode effects which degrade sonic quality in high fidelity applications, and to space the conductors from each other so as to better approximate a conducting cylinder. It should be noted that the same objective and functional result could be achieved, though not preferred and of more difficult construction, by embedding or cementing the conductors 22, 24, 26 onto the outer surface of the core tube 32 either in a straight, parallel, i.e. linear, fashion, or spiraled—with or without the insulating tubes 28.

Figure 8:
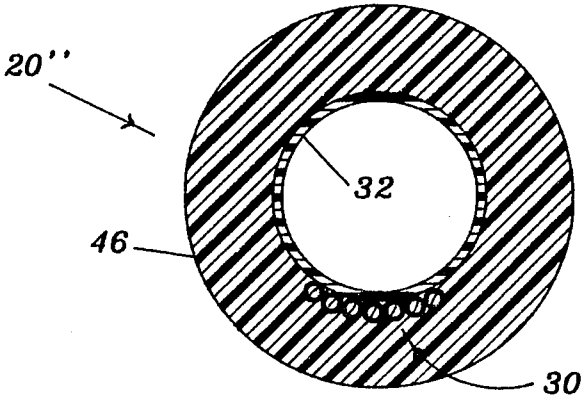
FIG. 8 is a simplified cutaway end view of a single conductor cable according to the present invention in a second alternate embodiment thereof.
Figure 10:
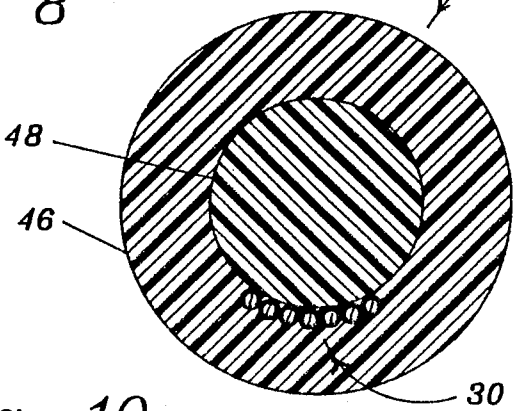
FIG. 10 is a simplified cutaway end view of a single conductor cable according to the present invention in a fourth alternate embodiment thereof.
Figure 7:
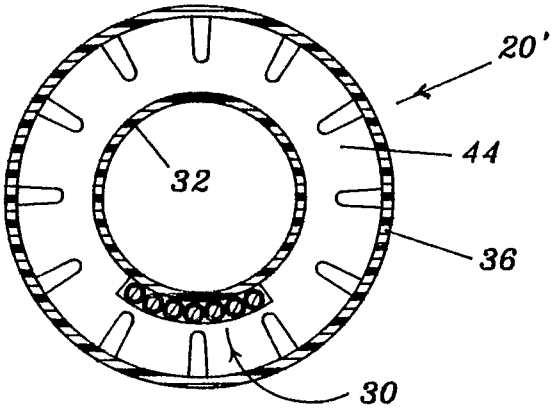
FIG. 7 is a simplified cutaway end view of a single conductor cable according to the present invention in a first alternate embodiment thereof.
Figure 9:
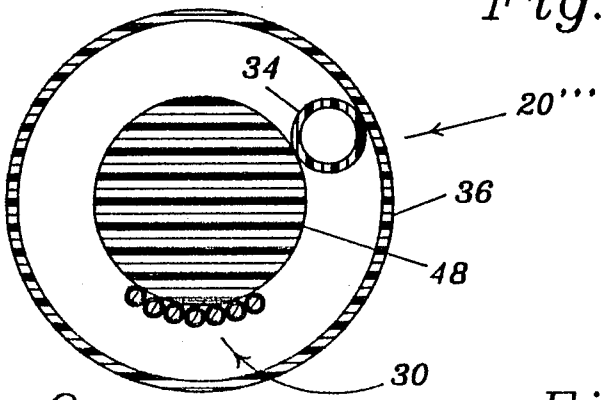
FIG. 9 is a simplified cutaway end view of a single conductor cable according to the present invention in a third alternate embodiment thereof.

Those skilled in the art will also appreciate that various modifications could be made to the basic cable assembly within the scope and spirit of the present invention. Several alternate constructions as contemplated by the applicant are shown in FIGS. 7–10. For example as shown in the assembly 20' of FIG. 7, the spacer tube 34 could also be replaced with alternate devices known in the art such as a plurality of insulating spacer discs concentrically disposed at spaced intervals along the length of the core tube 32. In like manner, as indicated in FIG. 8 as assembly 20'', the outer tube 36 could be replaced by suitable substitutes so as to define the spaced cylindrical support area spaced from the surface of the core tube 32. For example, an extruded solid plastic cylinder 46 as shown or a braided plastic strand structure (not shown) might be used in place of the tube 36. Other possibilities include the assembly 20''' of FIG. 9 wherein the core tube 32 is replaced with a solid cylindrical core member 48 and the assembly 20'''' of FIG. 10 wherein the solid cylindrical core member 48 is employed with the extruded solid plastic cylinder 46 over it. The solid components 46 and 48, of course, eliminate the air dielectric and are, therefore, not preferred and only suggested as possible less desirable substitutes.

Wherefore, having thus described my invention, I claim:

1. A signal-carrying cable having no delay from end to end as a function of the frequency of audio-range signals conducted therethrough comprising:

(a) an elongated cylindrical core member of a flexible insulating material extending between the ends of the cable;

(b) a plurality of fine strands of an electrical conducting material longitudinally disposed between the ends of the cable along the outer surface of said core member, said strands being electrically insulated from one another and comprising a mixture of 34-gage, 37-gage and 40-gage conductors, the diameter of said cylindrical core member being sufficiently large with respect to the thickness of said strands that the cable effectively comprises all skin conductors;

(c) spacer means disposed along the length of said core member for defining a cylindrical support area radially spaced from said outer surface of said core member; and, (d) electrical shield means disposed on said spacer means.

2. The cable of claim 1 wherein said spacer means comprises:

(a) an elongated spacer member of a flexible insulating material helically wrapped about said core member; and, (b) a cylindrical support tube of a flexible insulating material disposed over and supported by said spacer means.

3. The audio cable of claim 2 wherein:

said elongated spacer member is a hollow plastic tube.

4. The audio cable of claim 1 wherein:

said spacer means comprises a solid plastic cylinder concentrically disposed over said core member and said strands of electrical conducting material.

5. The audio cable of claim 1 wherein:

said core member is a hollow plastic tube.

6. The audio cable of claim 1 wherein:

said core member is a solid plastic cylinder.

7. The audio cable of claim 1 wherein:

said strands are individually insulated and are helically wrapped around said core member.

8. The audio cable of claim 1 wherein:

said strands are longitudinally disposed along the surface of said core member and attached thereto in non-electrically contacting spaced relationship to one another.

9. The audio cable of claim 1 wherein:

said strands comprise one 34-gage, three 37-gage, and three 40-gage conductors.

10. A two conductor audio cable having no delay from end to end as a function of the frequency of audio signals conducted therethrough comprising:

(a) a first elongated cylindrical core member of a flexible insulating material extending between the ends of the cable;

(b) a plurality of first strands of an electrical conducting material longitudinally disposed between the ends of the cable along the outer surface of said first core member, said first strands being electrically insulated from one another, the diameter of said first cylindrical core member being sufficiently large with respect to the thickness of said first strands that said first strands comprise a cable of effectively only skin conductors, said first strands comprising a mixture of 34-gage, 37-gage and 40 -gage conductors;

(c) a first cylindrical support member of a flexible insulating material concentrically disposed over said first core member and extending between the ends of the cable;

(d) a second elongated cylindrical core member of a flexible insulating material extending between the ends of the cable;

(e) a plurality of second strands of an electrical conducting material longitudinally disposed between the ends of the cable along the outer surface of said second core member, said second strands being electrically insulated from one another, said second strands comprising a mixture of 34-gage, 37-gage and 40-gage conductors;

(g) a second cylindrical support member of a flexible insulating material concentrically disposed over said second core member and extending between the ends of the cable; and, (h) flexible electrical shield means disposed around said first and second support members and extending between the ends of the cable for holding said support members together in parallel relationship and for providing electrical shielding for said first and second strands.

11. The audio cable of claim 10 wherein:

said strands are individually insulated and are helically wrapped around respective ones of said core members.

12. The audio cable of claim 10 wherein:

said strands are longitudinally disposed along the surface of respective ones of said core members and the individual strands attached thereto in non-electrically contacting spaced relationship to one another.

13. The audio cable of claim 10 wherein said first and second support members comprise:

(a) first and second elongated spacer members of a flexible insulating material helically wrapped about respective ones of said core members; and, (b) first and second elongated support cylinders of a flexible insulating material disposed over respective ones of said first and second elongated spacer members.

14. The audio cable of claim 10 wherein said first and second support members comprise:

first and second elongated solid plastic cylinders of a flexible insulating material concentrically disposed over respective ones of said core members.

15. The audio cable of claim 10 wherein said first and second support members comprise:

(a) a plurality of first and second spacer discs of an insulating material concentrically disposed about respective ones of said core members at spaced intervals along the length thereof; and, (b) first and second elongated support cylinders of a flexible insulating material disposed over respective ones of said first and second spacer discs.

16. The audio cable of claim 10 and additionally comprising:

an elongated, insulated, flexible ground conductor helically wrapped around said flexible electrical shield means and extending between the ends of the cable.

17. A signal-carrying cable having no delay from end to end as a function of the frequency of audio-range signals conducted therethrough comprising:

(a) means for defining an elongated cylindrical conductor with all "skin" and no central inner conducting capability, said means comprising a(1) an elongated cylindrical core member of a flexible insulating material extending between the ends of the cable; and, a(2) a plurality of fine strands of an electrical conducting material comprising a mixture of 34-gage, 37-gage and 40-gage conductors longitudinally disposed between the ends of the cable along the outer surface of said core member, said strands being electrically insulated from one another, the diameter of said cylindrical core member being sufficiently large with respect to the gage of said strands that said strands are effectively only skin conductors; and, (b) means for concentrically supporting an elongated cylindrical shield about said cylindrical conductor in insulated spaced relationship thereto.

18. The signal-carrying cable of claim 17 wherein said means for concentrically supporting an elongated cylindrical shield about said cylindrical conductor in insulated spaced relationship thereto comprises:

(a) spacer means disposed along the length of said core member for defining a cylindrical support area radially spaced from said outer surface of said core member; and, (b) electrical shield means disposed on said spacer means.

* * * * *